United States Patent [19]

Baldwin

[11] Patent Number: 4,976,590

[45] Date of Patent: Dec. 11, 1990

[54] FLUID CONDUIT-RESPONSIVELY ADJUSTABLE PUMP ARRANGEMENT AND PUMP/CONDUIT ARRANGEMENT AND METHOD, AND FLUID CONDUITS THEREFOR

[76] Inventor: Brian E. Baldwin, 8022 S. Niagara Way, Englewood, Colo. 80112

[21] Appl. No.: 203,926

[22] Filed: Jun. 8, 1988

[51] Int. Cl.[5] ..... F04B 43/12

[52] U.S. Cl. ..... 417/53; 417/477

[58] Field of Search ..... 417/53, 44, 475, 477

[56] References Cited

U.S. PATENT DOCUMENTS

| | | | |
|---|---|---|---|
| 3,140,666 | 7/1964 | Currie | 417/477 |
| 3,353,491 | 11/1967 | Bastian | 417/477 |
| 3,723,030 | 3/1973 | Gelfand | 417/475 |
| 3,740,173 | 6/1973 | Natelson | 417/477 X |
| 4,108,575 | 8/1978 | Schal | 417/475 |
| 4,347,874 | 9/1982 | Sullivan et al. | 604/250 X |
| 4,496,295 | 1/1985 | King | 417/477 |
| 4,585,399 | 4/1986 | Baier | 417/477 |
| 4,673,334 | 6/1987 | Allington et al. | 417/475 X |
| 4,798,590 | 1/1989 | Leary et al. | 417/477 |

FOREIGN PATENT DOCUMENTS

| | | | |
|---|---|---|---|
| 1257477 | 12/1971 | United Kingdom | 417/477 |
| 2107797 | 5/1983 | United Kingdom | 417/475 |

*Primary Examiner*—Leonard E. Smith

*Assistant Examiner*—Eugene Szczecina, Jr.

*Attorney, Agent, or Firm*—Reginald F. Pippin, Jr.

[57] ABSTRACT

A rotary peristaltic pump arrangement and method, with a set of specially constructed tube set conduits interchangeably interconnectable in selectively responsively sensed and operationally affecting relationship with the pump. The pump is driven by a pulse-actuated stepping motor, and the total quantity of pulses fed to the pump for any selected volume from one of the conduits is controlled by and as a function of which one of the set of plural sizes of tube set conduits is connected to the pump. The control is automatically affected through actuation or nonactuation of at least one switch sensor on the pump by special anchor-connecting flanges on the tube set conduits which interchangeably mate in anchored connection with corresponding anchor-connection slots on the pump and adjacent one which the switch sensor is disposed. Inaccuracies in volume pumped for a given quantity of pulses applied to the pump to effect a selected desired volume are minimized by adjusting the total quantity of pulses applied to the pump for a given desired volume, and/or for subsequent selected volumes, if desired, as a function of the ratio of the given desired volume relative to actual volume pumped by the application to the pump of the quantity of pulses estimated or calculated to be required for pumping the given desired volume through a given tube set conduit.

49 Claims, 5 Drawing Sheets

FLUID CONDUIT-RESPONSIVELY ADJUSTABLE PUMP ARRANGEMENT AND PUMP/CONDUIT ARRANGEMENT AND METHOD, AND FLUID CONDUITS THEREFOR

DESCRIPTION OF THE INVENTION

This invention relates to peristaltic pumps and fluid conduits therefor, and more particularly to a pharmaceutically usable digitally incrementally driven rotary peristaltic pump arrangement and control method, and to a set of associated special different-sized tube set conduits interchangeably interengageable in operationally connected relation with the pump to effect appropriately responsive control of the total actuation of the pump for a selected volume of fluid to be pumped through a particular one of the set of plural different-sized tube sets that may be operationally connected to the pump.

Both sterile injectable syringes for syringe infusers, PCA systems or hypodermic/IV push use and nonsterile oral liquid syringes are filled in pharmacies. Sizes range from 1 ml to 60 ml. Oral liquids often are viscous or heavy suspensions.

Vials containing from 5 ml to 60 ml are filled for delivery of unit doses of oral liquids. The oral liquids are often viscous or heavy suspensions.

Most of the reconstitution of lyophylized and other dry powder drugs requires the addition of 50 ml or 100 ml to vials or, in the case of Lilly Fastpak, a plastic pouch. Accuracy is not always a major factor when the total contents of the vial are administered to a single patient. However, in many cases there will be a bulk medication vial where the contents are subdivided and administered in multiple doses. In this case, relatively close accuracy is required to obtain an acceptable degree of accuracy for a desired concentration in milligrams of drug per milliliter of solution. In all reconstitution work, speed is also very desirable. To the best of my knowledge, the fastest pump prior to this invention has been the ADS 100, which pumps at a speed of 9.6 ml/sec.

There are many fluid transfers required in preparation of special IV solutions or other injectable drugs. Often this involves the addition of electrolytes or vitamins to the standard preparations.

In Total Parenteral Nutrition (TPN) preparation, there are usually three or four components consisting of up to seventy percent (70%) dextrose, amino acids, saline and sometimes a fat emulsion, where higher caloric intake is required. In addition, there may be many other small-volume additions of electrolytes such as KC1 and many trace elements such as zinc, magnesium, etc. Many of these additions are done with syringes and sometimes a repeating syringe, which has a spring return plunger and a double check valve which allows fluid to be drawn into the syringe as well as expressed.

There are a number of applications where there is a need to collect the contents of a number of vials into a large sterile bag or bottle for redistsribution into a number of syringes. This is a typical step prior to sterile syringe filling.

There is also a need to fill drug containers which take the form of rubber balloons which have to be inflated. This requires a pressure of more than 12 psi, and is very difficult to do by hand using the present industry practice of filling with a syringe.

As can be seen from the foregoing discussion of various needs of pharmacy operation, there is a need for a high-speed and a very accurate pump. There is also a need for the pump to have speed adjustment for enabling pumping various different viscosity solutions, including very viscous solutions, or to accommodate high-outlet line-back pressure caused by small needles or filters in the line. In all cases, the volumetric delivery of peristaltic pumps will vary considerably with changes in line-back pressure. Peristaltic pumps are well-suited for high-speed fluid delivery, but they will not have predictable accuracy of delivery when back pressure changes.

Various prior peristaltic pump arrangements have been employed for pharmaceutical fluid filling.

One prior art pump known as the Wheaton pump is provided in two types, single speed and variable speed, and uses a two-roller rotary peristaltic system. The pump will accept several different-sized tube diameters. The volume is set by reference to data previously developed, which relates the volume delivered with the time of rotation. The pump uses an electric motor drive with a clutch-brake system. The user must modify the time setting to make volume adjustments. The Wheaton pump was originally designed for laboratory use in filling culture media.

Another pump known as the ADS 100 pump is a fixed-speed pump using the German Hein dual roller peristaltic pump head. It uses only one size tube with a 6 mm inside diameter and a 2 mm wall. The pump delivers 9.6 ml/sec. There is no accuracy-adjustment system. The tube sets are calibrated to provide reasonable accuracy at deliveries of 50 ml or higher with adjustments. The pump was designed to provide a means of adding diluent to Lilly Fastpak bag for reconstituting dry powder drugs.

In the Bard pump, which is used to fill 10 ml–50 ml syringes, one at a time, the Barnant pump system is employed, which uses a PVC pump tube requiring disassembly of the pump head with tools, in order to install new tube sets. It is fixed-speed, and relatively slow.

Another prior art pump known as the Acacia pump has been recently introduced, this being a private-label pump made by Manostat. It has a digital input and readout system with a microprocessor control. Tube size must be input manually by use of a designated program number for each tube size. The volume is set by reference to preestablished data relating rotation-time-to-volume-delivered.

Other prior art pumps include the BD pump and the Solopak pump (Barnant), both of which appear to be very similar to the Bard pump.

The presently available Acacia tube sets (U.S. Pat. No. 4,347,874) are used in conjunction with the Wheaton pump or the Physio Control (Lilly) pump. The patent describes prior art used for the transfer of diluent to dry powder held in vials of IV piggyback containers. Typically, 50 ml of diluent is added to a 100 ml vial. The prior art described in the patent disclosed the use of a secondary transfer set which is attached to the inlet end of a sterile silicone tube which has a vented needle on the outlet end. The patent is related to the higher speed achieved by having a larger pump tube, but keeping the inlet and outlet tubes at less than half the outer diameters of the rubber pump tube.

Peristaltic pumps are ideal for pumping sterile fluids, since they use inexpensive fluid conduits in the form of flexible tube sets which can be sterile disposables and can be installed without problems of contamination.

It is an object of this invention to provide a peristaltic pump which will accommodate different sized tube sets that can be easily installed, in which the pump will automatically sense which one of at least two different sized tube sets is installed, and which will automatically compute the total rotation of the peristaltic rollers for a selected input volume, for that tube size, according to estimated, calculated, empirically determined or otherwise determined data for pumped volume per amount of pump rotation for the respective tube set sizes.

A further important object of the invention is to provide a peristaltic pump arrangement which can be easily adapted to serve substantially all of the needs discussed above which are required in pharmacy operation.

Still a further object of the invention is to provide a pump which is compact and in which tube sets are easily operationally connectable thereto and removable therefrom.

Another object is to maximize the pump speed and to maximize fluid delivery rate, while maintaining acceptable accuracy of fluid delivery, to an extent greater than other previously available pumps.

Another object is to provide a pump capable of reduced speed to handle very viscous solutions, or situations where fluid flow is restricted by devices such as small needles or filters.

Still a further object is to provide a pump/multiple tube set arrangement in which the same pump head accepts and is effectively operational with a variety of interchangeably operationally connectable different tube sizes, without need to mechanically change the rotor and stator dimensions or characteristics, and with desired changes in tube sets of different sizes being quickly and easily made, without any need for, or use of, of tools or exchanged parts.

The accuracy of a rotary peristaltic pump is dependent on a large number of variables, including inside diameter accuracy, wall thickness accuracy, length of the pump tube or stretch over the rollers, elasticity of the rubber, speed of the rotor, line suction pressure at the inlet and the flow restriction and outlet back pressure.

All of the above variables, and probably other factors also, make it impossible to precisely accurately compute the fluid output of a rotary peristaltic pump in terms of the total movement of pump rotor relative to the pumping conduit or tube set. It is an object and feature of one optional combination aspect of the invention to enable achievement of high accuracy with ease, by entering the actual first cycle delivered volume into the controls of the pump and to have this data used in computing the needed accuracy adjustment in total rotation movement of the pump rotor and its rollers, so that subsequent pumping cycles, under the same operating conditions and for the same volume, will be adjusted by the same accuracy adjustment factor and will thus have a highly accurate adjustment- corrected adjusted total rotor movement for the given volume.

For many pharmacy operations, the tube set employed, as well as other operating conditions such as inlet pressure drop and outlet back pressure, will remain constant for succeeding fill cycles, with the only change being the desired delivered volume. It is accordingly a further object and feature of a modification of the one aspect of the invention immediately indicated above that after an accuracy adjustment factor is determined for the first volume setting, such accuracy adjustment factor may thereafter be selectively automatically carried over and applied for additional fill cycles, including those fill cycles for which the volume is changed.

A further object is to be able to fill two syringes at a time as one of the options. There is a need for high-productivity syringe filling, and handling two syringes at a time will nearly double the productivity.

Another object of the invention is to provide a rotary peristaltic pump arrangement and method in which sensing means detect which of plural different sized pumping conduits, formed by tube sets having different sized pumping tube sections, are connected, and in which the quantity of rotor movement for delivery of a desired volume is automatically computed for any one of a set of plural selected sizes of tube sets, based on stored data which has been estimated, calculated, empirically or otherwise determined..

Still other objects, features and attendant advantages will be apparent from a reading of the following description of an illustrative and preferred embodiment and practice of the invention, taken in conjunction with the accompanying drawings, wherein.

Figure 2:
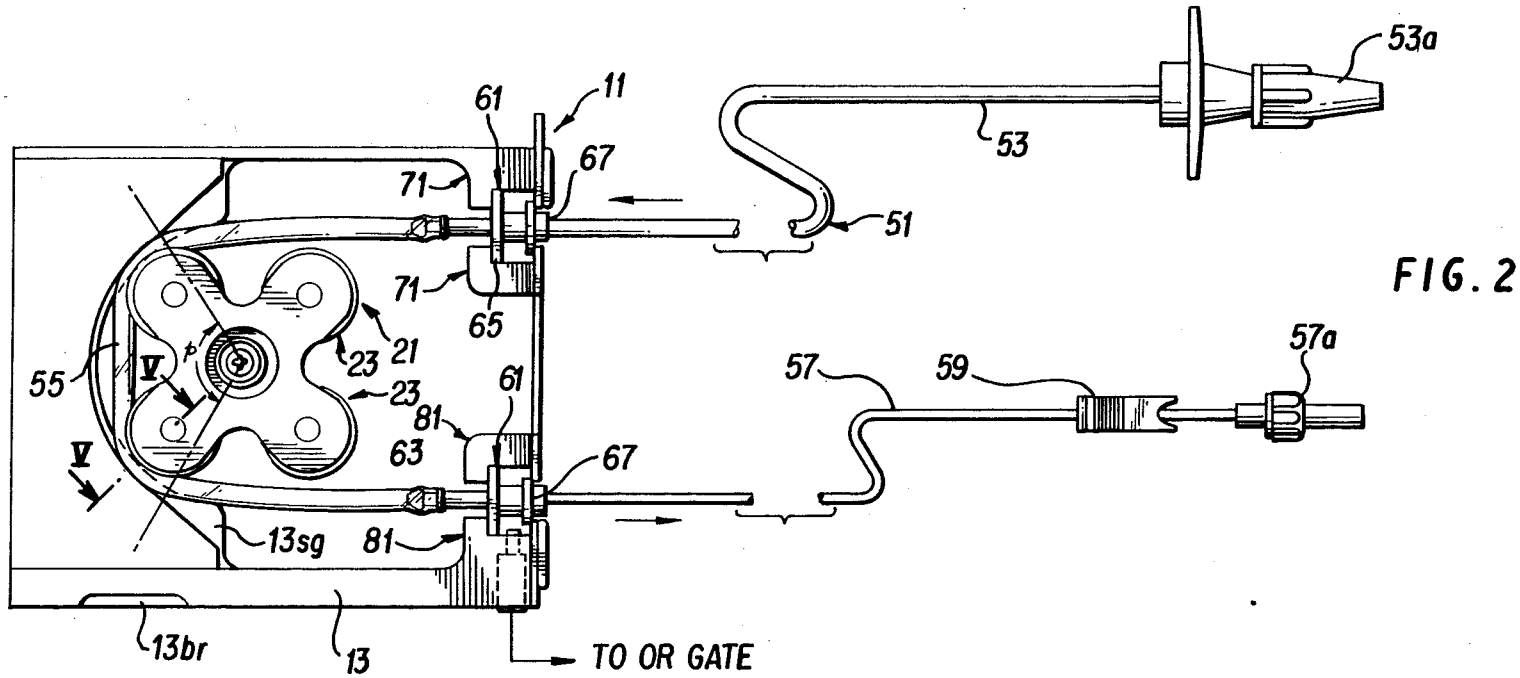
FIG. 2 is a schematic plan view illustrating the pump of FIG. 1 with one size of tube set operationally installed therein.
Figure 2A:
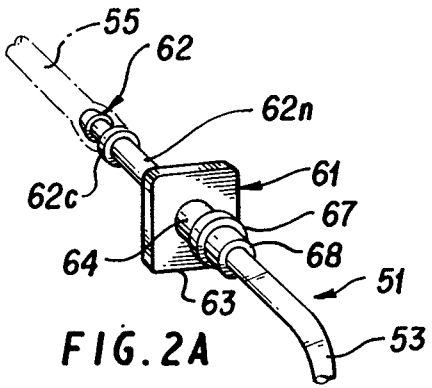

FIG. 2AA is an isometric illustration of one of the two anchoring connectors of the smaller sized tube set of FIG. 2.

Figure 1:
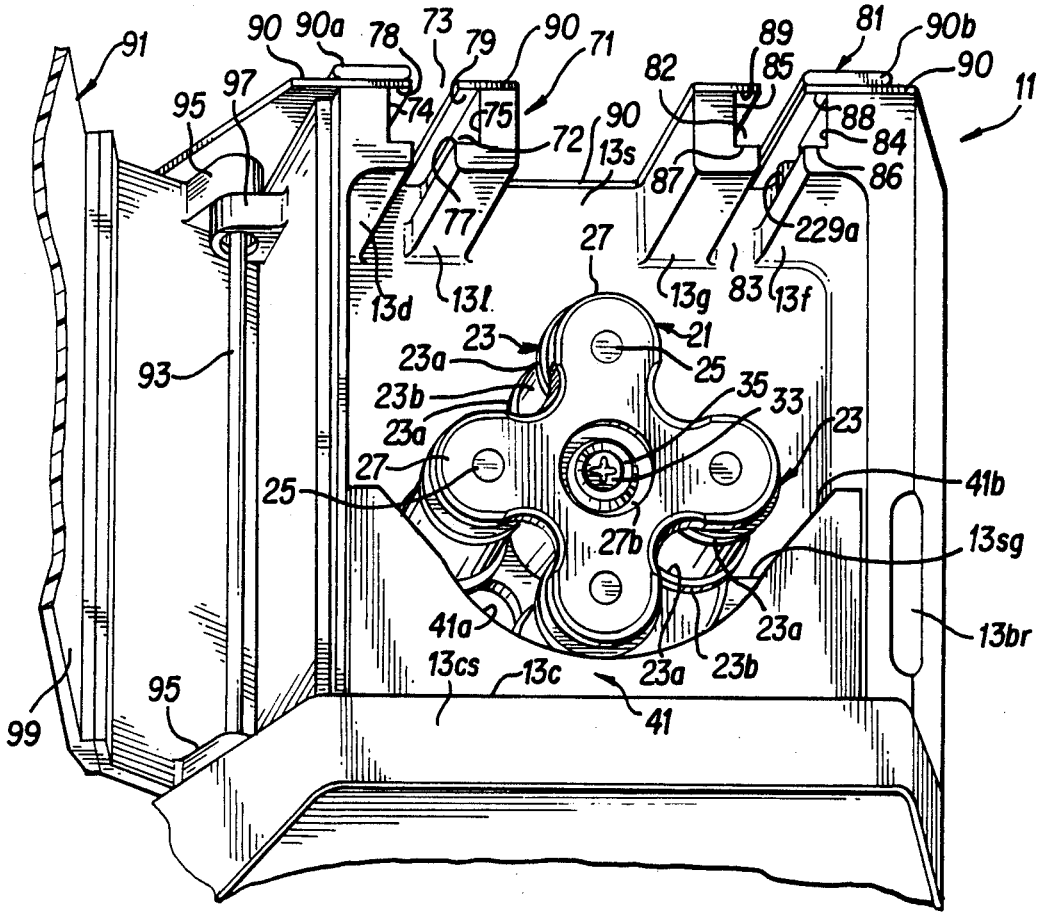
FIG. 1 is an isometric illustration of a peristaltic pump embodiment according to the invention, taken as viewed from the front and top sides of the pump.
Figure 3:
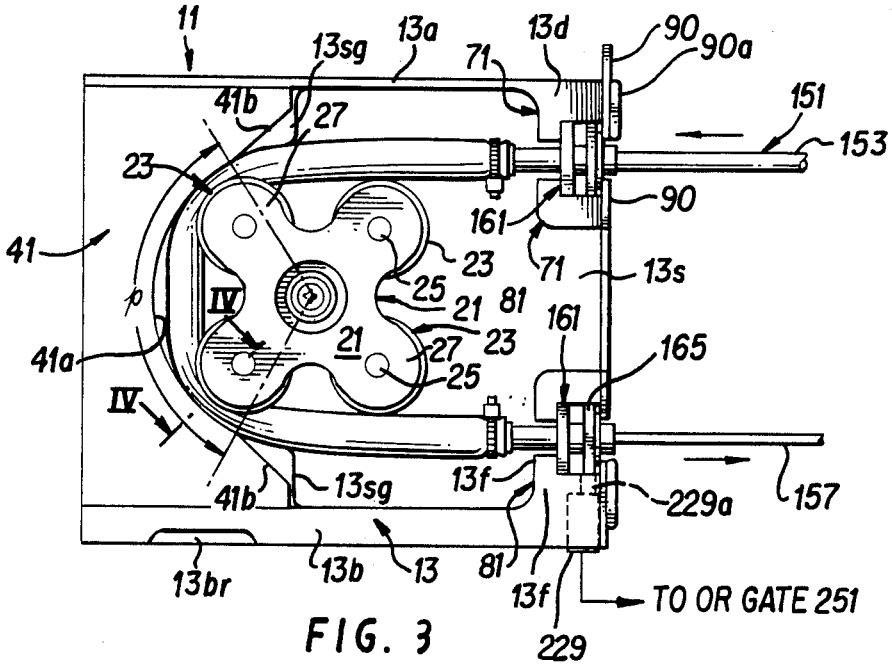

FIG. 3 is a schematic plan view illustrating the pump of FIG. 1 with a second larger size tube set, having a larger sized peristaltic pumping tube section, operationally installed therein.

Figure 3B:
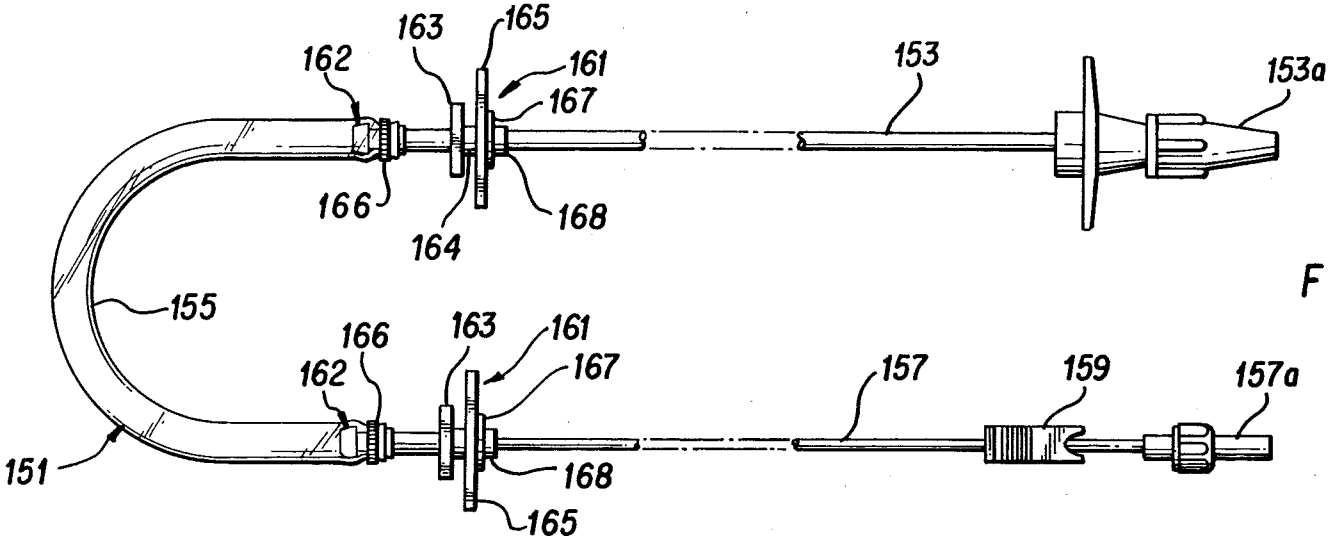
Figure 3A:
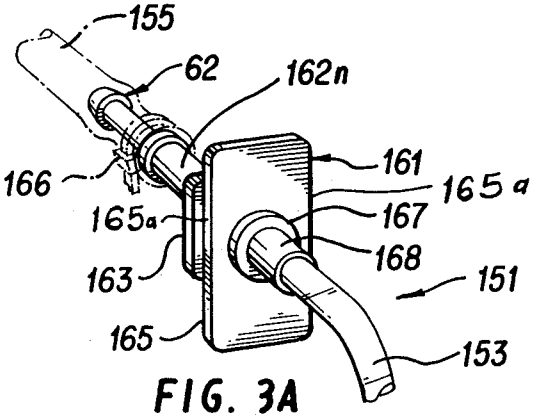

FIG. 3A is an isometric illustration of one of the two anchoring connectors of the larger sized tube set of FIG. 3.

FIG. 3B is a side elevation view of the larger tube set shown in FIG. 2.

Figure 4:
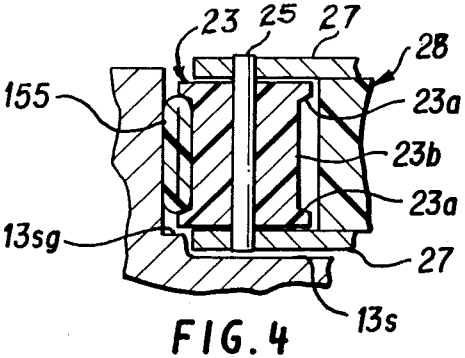

FIG. 4 is a section view taken along Line IV—IV of FIG. 3.

Figure 5:
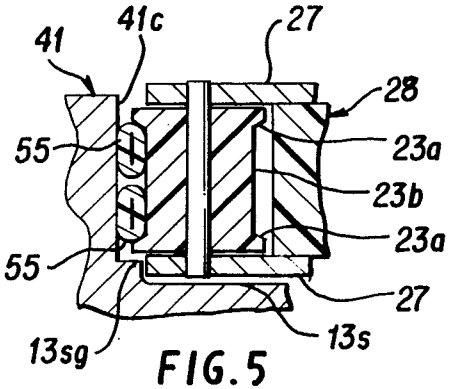

FIG. 5 is a section view taken along Line V—V of FIG. 2, and illustrating the accommodation of two identical tube sets having the smaller sized pumping tubes of FIG. 2.

Figure 6:
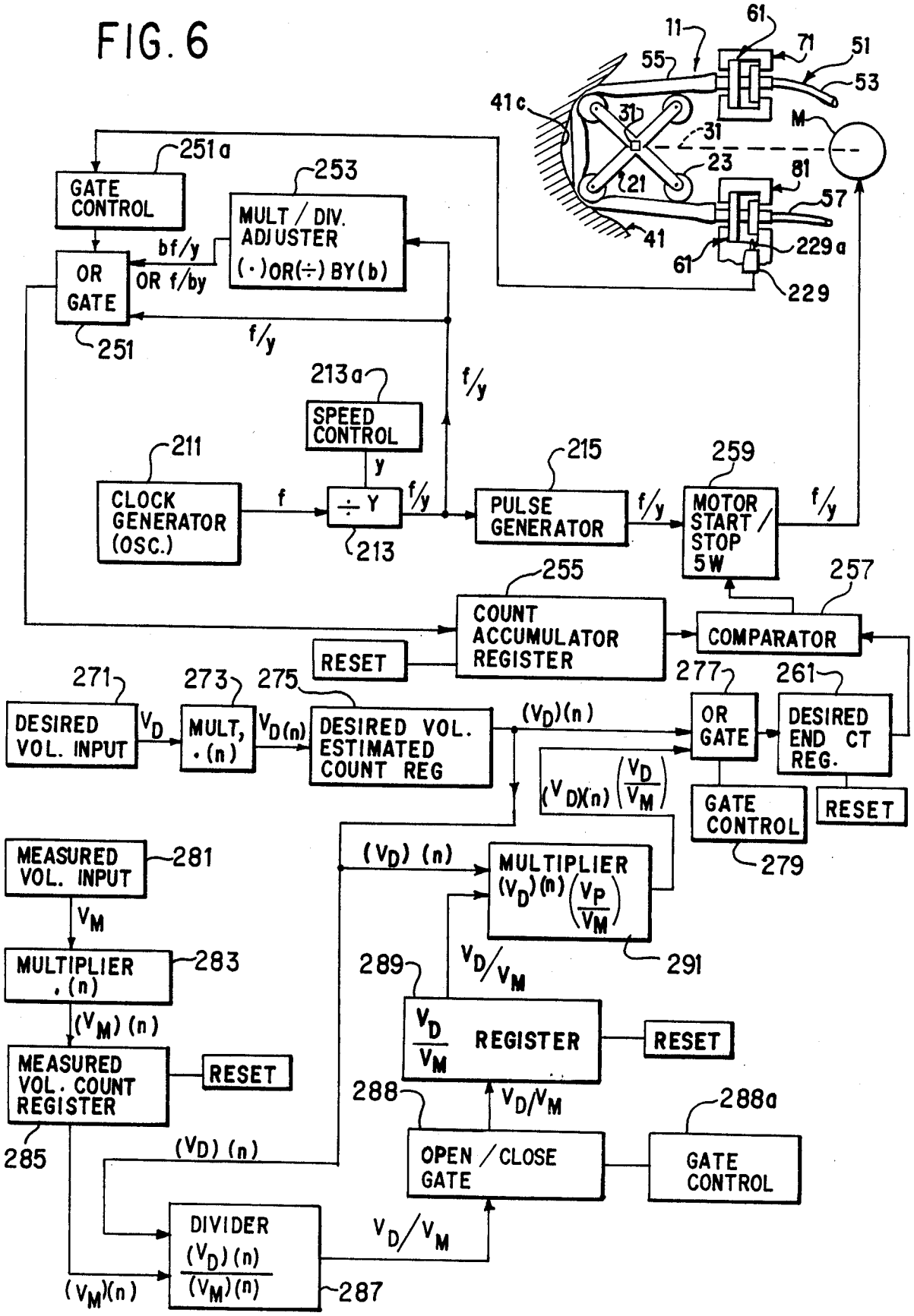

FIG. 6 is a schematic mechanical and electrical block diagram illustrating a pump, peristaltic pumping tube and pump control arrangement according to the invention.

Figure 7:
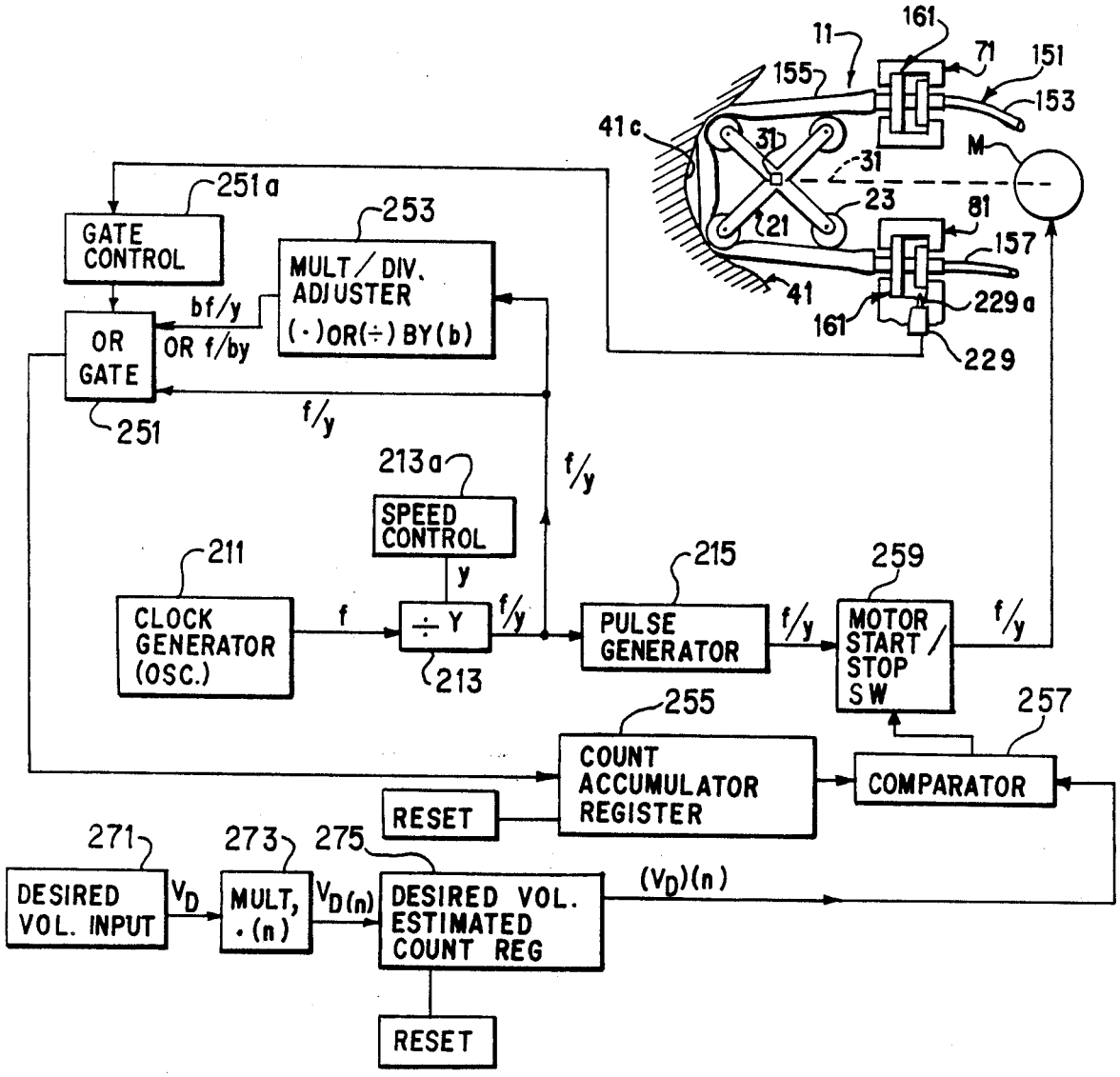

FIG. 7 is a schematic meachanical and electrical block diagram illustrating a modification according to the invention.

Referring now in detail to the Figures of the drawings, a peristaltic pump 11 has a pump head which includes a rotor 21, a fixed stator 41 and spaced anchoring connection elements 71, 81 for slidably removably anchored connection thereto of any of several selected different sized conduits which may and preferably take the form of specially constructed tube sets 51 and 151 having specially configured anchor connectors 61, 61 and 161, 161 respectively, which enable both ease of anchored connection or attachment to the pump 11 as well as enabling the pump control arrangement to sense which size of a plurality of sizes of such tube sets is operationally connected to the pump.

Rotor 21 has four equally spaced tube-engageable rollers 23 each freely rotatably mounted on a drive sprocket formed by upper and lower spiders 27 with a central cylindrical spacer block 28 therebetween. Rollers 23 are each mounted on a respective shaft 25 press fit into opposing spiders 27.

The rollers 23 preferably have peripherally bevelled or tapered tube-retaining end flanges 23*a* at their opposite upper and lower ends, with a cylindrical wall section 23*b* connecting therebetween and which serves in conjunction with the facing surface 41*a* of stator 41 to effect rolling peristaltic squeezing of the particular sized tube set or other suitable conduit 51 or 151 which is operationally connected to the pump 11. Spiders 27 and spacer cylinder block 29 are suitably fixedly secured to radially centered drive shaft 31 as by a securing screw 33 and compression washer 35 or other suitable securing means. The drive shaft 31 may be suitably interfitted in positive driving relation to the spiders 27 and spacer block 29, as by a cross-sectionally noncircular complementary mating interfit therebetween such as formed by a square section of shaft 31 and a complementary square bore in each of the spiders 27 and spacer block 29 to assure positive nonslip driving of the rotor 21. The securing screw 33 and washer 35 may be suitably disposed in a recess 27*b* formed in the upper face of upper spider 27 to assure noninterference with the closing of a pivotally mounted cover 91, to be later described.

Pump 11 includes a housing 13 containing a stepping motor M actuated by a control arrangement to be later described, and which control arrangement is also preferably disposed within pump housing 13. Housing 13 has a recessed pump head floor surface 13*s* bounded by upstanding side walls 13*a*, 13*b*, an end wall 13*c* and end posts 13*d*, 13*e* and 13*f*, 13*g* forming a portion of anchoring connection elements 71 and 81 respectively.

The upper surfaces of side walls 13*a* and 13*b* and end posts 13*d*, 13*e* and 13*e*, 13*f* are preferably recessed below the surface of end wall 13*c* to enable closure of the cover 91 with its upper outer surface flush with the adjacent upper surface 13*cs* of end wall 13*c*. Likewise, the upper surface of stator 41 and the upper one of spiders 27 are preferably recessed below the cover support surfaces formed by the upper surfaces of walls 13*a*, 13*b* and 13*c* and end posts 13*d*, 13*e* and 13*f*, 13*g*.

Cover 91 is pivotally mounted on and forms a cover for the housing 13, being mounted as by a pivot shaft 93, shaft receiving bosses 95 and spaced bearings 97 in which shaft 93 may rotate to enable opening and closing of cover 91. Cover plate 99 of cover 91 preferably is formed of transparent or translucent material to enable external viewing of the pumphead therebeneath when the cover is closed. A finger-accommodating recess 13*br* may be formed in side wall 13*b* to enable ease of opening of the cover 91, as the cover plate 99 preferably extends over and rests on side wall 13*b* as well as side wall 13*a* in the closed position. The closure of the cover 91 aids in assuring effective switch actuation sensing seating of the tube sets 151 in anchoring connection elements 71 and 81, as will be later described.

Stator 41 has a curved peristaltic pumping action surface 41*a* having the same radial center of curvature as rotor 21, and which surface 41*a* faces rollers 23 at fixed spaced relation thereto along a constant radius over an angle p sufficient to assure effective peristaltic progressive roller-engaging squeezing action by the four 90 degree arcuately spaced parallel axis rollers 23. The fixed radius peristaltic action surface 41*a* of stator 41 is thus spaced a constant distance from the cylindrical surface 23*b* of each of rollers 23 as the rollers 23 progress past stator surface 41*c* in the peristaltic pumping action zone defined by the angle p as shown in FIGS. 2 and 3. The surface 23*b* of each of rollers 23 together with the stator surface 41*c* serve to progressively squeeze the elastically compressible flexible peristaltic pumping tube section 55 or 155 which may suitably be formed of silicone rubber or other desired material, of tube set pumping conduits 51 or 151, to thereby progressively move the squeeze zone along the length of the constant radius surface 41*c* of stator 41, so as to force the liquid content in peristaltic pumping tube section 55 or 155 along this tube section in the direction of rotary motion of the rotor 21, which in the illustsrative embodiment is in a counterclockwise direction as viewed in the respective Figures.

In the illustrated and preferred embodiment the pump head employs four rollers 23. To pump effectively there must always be at least one roller 23 squeezing the tube section 55 or 155 at any rotary position of the rotor 21. Thus, for the four roller sprocket rotor of this embodiment, the fixed curved stator surface 41*c* must extend over an angle of arc p of at least 90 degrees. In practice it has been found that an angle of arc p in the range of approximately 110 degrees to 130 degrees is preferable and affords best results for this embodiment.

For the pump 11 to be able to utilize and operate with tube set conduits which have several different delivery rates for the same rotation speed pump rotor 21, such may be effected with interchangeably matched sets of tube set conduits 51 and 151, the respective pumping tube sections 55 and 155 of which tube set conduits 51 and 151 have selected respectively different diameters. In one illustrative and preferred embodiment of this invention, different sized tube sets may be employed which respectively utilize a large pumping tube 153 of 6 mm ID and 2 mm wall thickness for the high flow rate, and tube set 51 with a smaller 3 mm ID and 2 mm wall thickness of its pumping tube section 53 for a lower flow rate. Alternatively, a tube set having 1.5 mm ID and 2 mm wall thickness may be employed as one of a set of two different sizes of tube sets 51, 151, to thereby provide for micro flow rate filling. As can be seen, the wall thickness is the same for all of the pumping tubes 55 and 155, which permits interchangeable operation with the same spacing between the roller and fixed surface. This allows the changing to different tube sets 51 and 151 without mechanical changes to the rotary pump section.

The roller surfaces 23*b* and curved stator surface 41*c* are parallel to one another and are parallel to the axis of rotor 21. As shown in FIG. 5, the roller surfaces 23*b* have an axially extending length sufficient to accommodate optionally either one or two of the smaller sized tube set peristaltic pumping tube sections 55 of a given size, which in one illustrative embodiment is a peristaltic pumping tube section 55 of 3 mm ID and 2 mm wall thickness.

It will be appreciated that the radial clearance space between roller surface 23*b* and the facing fixed radius curved stator surface 41*a* must be such that the pumping tube squeezed therebetween is closed off at the squeeze zone. Accordingly, this roller/stator surface radial clearance spacing must be less than twice the wall thickness of the pumping tubes 55 and 155 or 153.

The length of the roller surfaces 23*b* in the illustrative embodiment will accommodate one of larger size tube set 51 having in one illustsrative embodiment an ID of 6 mm and a wall thickness of 2 mm. However, by extending the axial length of the parallel roller and stator squeeze surfaces 23*b* and 41*a*, more tube sets and/or still larger tube sets may readily be accommodated. It is to be noted and is an important feature of one aspect of the invention that the wall thickness is the same for each of the various pumping tube sections 55 and 155 having respectively different IDs.

By employing an equal wall thickness for the pumping tube section 55 and 155 of each of the various sized tube sets with different IDs, matched sets of various tube set sizes having respectively different IDs are provided, all of which various sized tube sets 51, 151, with matched equal wall thickness pumping tube sections 55, 155, may be used interchangeably on the pump 11 without necessity for mechanical change to the pump head components, including rotor 21 and stator 41.

By way of example of operation of an illustrative embodiment of the invention, the delivery rate by the pump through the tube sets 51, 151, etc. in one illustrative embodiment of the pump 11 and tube sets 51, 151 are 10.5 ml/sec for the high-flow 6 mm ID tube, and 2.6 ml/sec for the low-flow tube sets with 3 mm ID pumping tube sections. The corresponding delivery rate for one illustrative micro flow tube set with 1.5 mm ID is 0.65 ml/sec. There is a need for the different size tubes in pharmacy practice, since there are needs for both high-speed filling of volumes of 10 ml or greater up to a liter or more, whree fillcycle-to-fill-cycle repeatability accuracy of ±0.3 ml is acceptable and for greater accuracy filling of lesser volume quantities. This is the accuracy which has been achieved with an embodiment of pump 11 pumping through a 6 mm ID tube section 155. The degree of inaccuracy is due to the overall electromechanical system tolerances which can affect the total movement of the squeezing roller, as well as delivery changes due to the positions of the rollers on the fixed arc at the beginning and end of the cycle.

Greater accuracy is needed for smaller volume filling. An illustrative tube set 51 with a 3 mm ID pumping tube section 55 tube set embodiment has provided a fill-cycle respectability accuracy of ±0.08 ml, while a micro-filling tube set having a 1.5 mm ID pumping tube section 55 has provided a fill-cycle repeatability accuracy of ±0.02 ml. For 1 ml fills the small micro tube having the 1.5 mm ID will then fill with an acceptable accuracy of ±2%, or ±4% if filling ½ ml.

For users to be able to easily use the different sized tube sets 51 and 151 in the pump 21, it is very desirable for each of the tube sets to be easily placed in and connected to and removed from the pump 11.

It is also highly desirable that the pump 11 have means for automatically sensing which of a plurality of different sizes of tube sets is operationally connected to the pump, and for making automatic adjustment, if required, in the computation of the amount of rotor rotation required per unit volume to be pumped through a given size tube set connected thereto. Such automatic adjustment is effected by actuation of a suitable switch as a function of fully seated anchored connection of a given tube set to pump 11, and in the illustrated embodiment such is effected by a switch sensor 229*a* which extends in transversely movable relation through an opening in the lower outer end of slot sidewall 84, the sloped cam surface on its slot-facing protruding end to enable outwardly transverse switch-actuating displacement thereof by downward vertical sliding contact therewith of a flange portion of an appropriate given tube set as a function of slidably anchored connection of such tube set anchor connection into slot 84.

Such adjustments may be made based on calculations of fluid flow, empirical evidence as by prior calibrated testing and extrapolation, educated estimates, etc. for pumping a given unit volume or total volume of fluid with a selected size tube set (e.g., 51 or 151) having a particular ID pumping tube section (e.g. 55 or 155).

Each of two different sized tube sets 51 and 151, having respectively different ID-sized pumping tube sections 55 and 155 having the same wall thickness, are formed with inlet tubes 53 and 153 and outlet tubes 57 and 157 connected to the opposite ends of their respective pumping tube section 55 and 155, through the medium of anchor connectors 61 and 161 formed respectively thereon. The inlet and outlet tubes 53, 153 and 57, 157 may have any desired end connection fitting thereon as may be desired for a given utilization, as for example, vented or nonvented connectors, male or female Luer Lock connectors, weighted ends, filling bag inlet connectors, spike connectors, etc. In the illustrative embodiments, each of the inlet tubes 53 and 153 has a conventional nonvented IV bag spike connector 53*a* and 153*a* suitably secured thereon, while the outlet tubes have a conventional male Luer Lock connector 57*a* and 157*a* thereon, and a conventional manually operable off/on tube clamp 159 is mounted on each of the outlet tubes 57 and 157. The outlet tubes may suitably be formed of flexible plastic, such as polyvinylchloride (PVC) or other desired and suitable material, and the size of the inlet tubes 53 and 153 will normally be larger than the outlet tubes 57 and 157, and both inlet and outlet tubes may acceptably be somewhat smaller than the peristaltic pumping tube section, the ID size of which pumping tube section is the primary factor in the rate of peristaltic pumped fluid flow through a given tube set, assuming that the inlet tube is of sufficient size to accommodate the flow of fluid without collapsing, and the outlet tube and any unit connected thereto is not unduly restrictive so as to unduly restrict the flow which the pumping tube section is capable of pumping. In the illustrative and preferred embodiments it will be noted that the inlet tubes 53 and 153 for each of tube sets 51 and 151 have the same diameter size, as do likewise the respective outlet tubes 57 and 157, although different sizes for these corresponding tube sections may be employed if so desired. In general, a relatively wide latitude of inlet and outlet tube sizes and end connections may be accommodated, as may be deemed desirable in a given application.

Anchoring connection elements 71 and 81 have transverse slots 72 and 82 formed therein for interchangeably receiving anchor connector flanges 61 and 161 on each of the two different sizes of tube sets 51 and 151. Transverse slots 72 and 82 are formed respectively by opposed parallel side walls 74, 75 and 84, 85, and opposed parallel centrally split end walls 76, 77, 78, 79 and 86, 87, 88, 89, the split end walls having a longitudinal slot 73 and 83 respectively formed therein to slidably receive and accommodate the longitudinally opposite end sections of the anchor connector flanges 61 and 161. The primary guiding and anchored connecting and locating action both longitudinally and transversely or laterally on the tube set anchor connectors 61 and 161 is effected by the opposing side walls 74, 75 and 84, 85 and end walls 76, 77, 78 79 and 86, 87, 88, 89. End walls 73, 74 and 83, 84 are formed by an end plate 90 secured to the end face of the body of housing 13 as by securing strips 90*a* and 90*b* secured in place as by securing screws, brads, etc. (not shown) extending through plate 90 and into the adjacent face of the body of housing 13.

The anchor connectors 61 on the smaller sized tube set 51 are mutually interchangeably identical, and take the form of longitudinally spaced flanges or flange sections 63 and 67, while the anchor connectors 161 on tube set 151, which are also mutually interchangeably identical, take the form of longitudinally spaced flanges or flange sections 163 and 165, 167. Flanges 63, 63 on tube set 51 and flanges 163, 163 on tube set 151 are disposed adjacent the connector ends 62, 162 over which the respective pumping tube sections 55 and 155 are stretch-fitted and secured, the larger ID pumping tube section 155 having a suitable securing ring 166 thereabout, such as a tie ring or an o-ring, while the smaller ID tube section 55 may be suitably self-retained on the respective connector ends 62 through the elastic stretch-fit of its opposite ends over the respective connector ends 62.

The anchor connectors 61, 161 on the smaller sized tube sets 51 are devoid of means for operatively actuating a pump operation control switch 229, while the anchor connectors 161, 161 on the larger-sized tube sets have operative switch actuating means thereon in the form of transverse oblong rectangular flanges 165, the transversely oppositely facing outer parallel surfaces of the longer of the pairs of side walls 165*a* thereof forming sliding switch sensor-contacting and movement-effecting surfaces which laterally displace the switch sensor 229*a* to thereby effectively operate the switch 229 from normally open position to a closed position, for control circuit operational purposes as will be described more particularly in the description of FIGS. 6 and 7.

If desired, the combined thickness of end plate 90 securing plate 90*a* may be made greater than the distance between flanges 63 and 67 of tube sets 51, and flanges 163 and 165, 167 of tube sets 161, to assure against inadvertent improper connection of the anchor connectors 61 and/or 161 with their flanges 63 and/or 163 within the anchor connection slots 74 and 84 and with their flanges 67 and 165, 167 lying outside the slots 74 and 84 and adjacent the outer faces of end plate 90 and securing plates 90*a*, 90*a*. Likewise, the thickness of the anchor connection elements forming opposite end walls 76, 77, 86, 87 is preferably greater than the distance between flanges 63 and 67 and flanges 163 and 165, 167.

To effect these ends, while also providing effective longitudinal and transverse or lateral anchoring connection and removal of the anchor connectors 61, 61 and 161, 161 with pump anchoring connections 72 and 82 in an easy and facile manner, both of the anchor connectors 61, 61 and 161, 161 have in common a square rectangular transverse flange 163 adjoining the connector end thereof connected to the respective pumping tubes 55, 155. The square flanges 63, 63 and 163, 163 extend perpendicular to the length of the respective connectors 61, 61 and 161, 161, of which they form a part, and have a length along each square wall side sufficiently smaller than the transverse width between equally spaced apart slot side walls 72, 74 and 82, 84, so as to provide a complementarily snug but freely vertically slidable fit within both of the slots 72 and 82. Square flanges 63, 63 and 163, 163 serve as primary transverse and longitudinal anchoring and locating means for the connectors 61, 61 and 161, 161 and concomitantly for anchored connection of their respective interconnected pumping tube sections 55 and 155 on the pump 11.

At the longitudinally opposite outer ends of each of anchor connectors 61, 61 and 161, 161, each anchor connector has a further transverse flange 67, acting to effect sliding physicalcontact with and switch-actuating displacement 67 and 165, 167, 165, 167, respectively; the flanges 165, 167 and 165, 167 of switch sensor 229*a* as a function of sliding anchoring seated insertion of either of the anchor connectors 161, 161 within slot 82. On the other hand, the flanges 67, 67 are configured and located such that they serve as longitudinal slot retention and displacement anchoring means similarly to anchor flanges, while having no part thereof which intercepts and actuatingly moves switch sensor 229*a* along any portion of the insertion and seating path of either of the anchor connectors 61, 61 within slot 82. This may be accomplished in any one or more of several ways, such as by forming the flat cylindrical flange 67 of a sufficiently small diameter and physically locating the switch sensor 229*a* in an opening in the slot wall 84 forward of the insertion path and seated location of square flanges 63, 63; and vertically below the outermost circular rim portion of the small-diameter flat cylindrical flanges 67, 67 and extending a sufficiently small extent into the slot 82 such that it is out of any effective actuating contact by either flanges 63, 63 or flanges 67, 67 when the square flanges 63, 63 are fully seated on the floor 13*s*, which forms the bottom of slot 82, and/or by locating the switch sensor 229*a* longitudinally along slot wall 84 such that the anchoring insertion and seating physical displacement path of flanges 63, 63 and 67, 67 within slot 82 will not actuatably intercept the switch sensor 229*a*. As an alternative, the switch sensor 229*a* may be simply located longitudinally in slot wall 84 such that it is spaced longitudinally between and away from each of the longitudinally facing flat end surfaces of both flanges 63 and 67, while forming the oblong rectangular flanges 165, 165, with their respective opposite long switch-actuatable side walls 165*a* with a longitudinal wall thickness or displacement such that either of these side walls will actuatably intercept and displace switch sensor 229*a* as a function of anchoring seated insertion of anchor connectors 161, 161 within slot 82. Or the entire flange zone of anchor connectors 161 may be formed as a single locating, anchoring and switch-sensor contacting and actuating unitary flange block surface complementarily snugly fitting along all of or a major part of the inner end zone of, the length of slot wall surfaces 72, 74, 82, 84, so as to enable a wide latitude of switch sensor location while enabling use of a lesser or staggered length for the transversely outer guide surface or surfaces of the flanged anchor connectors 61, 61 so as to avoid switch sensor 229*a* actuation thereby. It will be apparent that various other selective switch-actuating/nonactuating arrangements may be employed in connection with various forms and constructions of anchor connectors 161, 61 and 161, 161, including employment and selective location of other switch and switch-sensor means such as magnetically actuated or optically actuated sensors.

The shorter of the opposite parallel side walls 165*b* of oblong rectangular flanges 165, 165 have substantially the same length as the length of each of the side walls of square flanges 163, 163 and 63, 63, and thus serve to additionally aid in transversely positioning and stabilizing the anchor connectors 161, 161 in slots 72 and 82.

The height of slots 72 and 82 preferably substantially corresponds to the length of the two longer switch-actuating parallel transverse side walls 165*a*, 165*a* of each of oblong rectangular flanges 165, 165, which length is also preferably generally twice that of the length of the smaller parallel side walls of each of flanges 165, 165 as well as the four side walls of square rectangular flanges 63, 63 on tube set 51. This assures that full anchoring seating of either of anchor connectors 161, 161 within slot 82 will effect switch-actuating lateral displacement of switch sensor 229*a*, while also enabling stacked disposition of two anchor connectors 61, 61 within each of slots 72 and 82 so as to enable anchored connection of each of the tube sets 51 on the pump 11 for simultaneous pumping action through both tube sets.

As an aid to more secure anchoring connection and to more precise positioning of the anchor connectors 61, 61 or 161, 161 within the pump anchor connection slots 72 and 82, the length of elastic peristaltic pumping tube sections 55 and 155 may be made of a length to require slight stretching to enable sliding anchored connecting engagement of each of the respective flanged anchor connectors 61, 61 and 161, 161 with its respective anchor-connection element slot 72, 83, thereby positioning the flanged anchor connectors 61, 61 and 161, 161 in a squared-up relationship flat against slot end walls 76, 77 and 86, 87.

As will be noted, the pump rotor 27 and stator surface 41*a* and anchor connection elements slots 72, 82 are all open at their upper ends, thereby enabling ease of installation and removal of a selected one of tube sets 51 and 151. The pumping tube sections 53 and 153 of either of the tube sets 51 or 151 may thus be simply progressively walked between rotor rollers 23 and stator surface 41*a* while rotating rotor 21 by hand, and thereupon the respective flanged anchor connectors 61, 61 or 161, 161 are gently pulled sufficiently to enable them to be slidably inserted and effectively anchored in substantially transversely centered relation within anchoring connection element slots 72 and 82. As an aid to preventing inadvertent catching of the pumping tube sections beneath the lower spider 27 of rotor 21, a slightly raised surface guide shelf 13*sg* may be formed on the recessed pump head floor surface 13*s* of housing 13 as shown particularly in FIGS. 4 and 5.

As previously noted, closure of cover 91 aids in assuring full seating of the switch-actuating flanged anchor connectors 161, 161 in their respective vertically open slots 72, 82 to assure switch actuation by a respective fully seated flanged anchor connector 161 within slot 82 having switch-actuating sensor 229*a* extending therein through side wall 84. By forming the cover plate 99 of generally transparent material, the pumping action by rotor 21 on the installed tube set 51 or 151 may be readily observed and monitored. Likewise, the height of each of slots 72 and 82 is sufficient to accommodate two of the flanged anchor connectors 61, 61 in vertically stacked seated relation therein, and this aspect together with the length of roller surfaces 23*b* enables the concurrent operative attachment of two of the smaller sized tube sets 51 about the rotor 21 and within anchoring connection element slots 72 and 82 for simultaneous dual pumping of fluid therethrough.

Referring now to FIG. 6, a suitable clock generator 211, which may be formed by a fixed-rate or adjustable-rate oscillator (although a stable fixed frequency oscillator such as a quartz controlled oscillator is preferred) feeds a higher frequency (e.g., 4 Mhz) signal than will be utilized for pump operation, through an adjustable divider 213 which provides a suitable lower frequency signal which is within a frequency range acceptable by stepping motor M. The output frequency of divider 213 may be suitably controllably varied by a speed control 13*a* which may function to vary the speed of motor M by varying the divisor y inputted to divider 213. The desired suitably lower frequency signal output from divider 213 is fed to a pulse generator 215 which forms pulses at the same frequency as the input signal thereto from divider 213, and having pulse characteristics suitable for driving a rotary stepping motor M which in turn rotates shaft 31 and rotor 21 of peristaltic pump 11, relative to stator 41.

A suitable switch 229, such as a microswitch, is suitably disposed in housing 13 with a switch-actuating sensor 229*a* therefor disposed adjacent one of the anchoring connection element slots 72, 82 for operative engagement by a particular selected configuration of flange 165 in the illustrated embodiment, to thereby enable automatic tube set responsive control of the quantity of pulse counts fed to an accumulated count register 55 per pulse-driven increment of rotational movement of pump rotor 21.

The simple mechanically actuatable on-off switch 229 enables accommodation of two different inner cross-sectional sized tube set conduits 51 and 151, and to this end the switch 229 controls an OR gate 251 which effectively switches the output signal of divider 213 either to feed directly to an accumulator register 255, or feeds this signal to the register 255 through a multiplier or divider 253 which applies an appropriate set multiplication or divide factor b suitable to correct for the calculated or estimated (as by empirical testing) different fluid flow rate through one of the two differently sized conduits 51 or 151 relative to the fluid flow rate through the other sized conduit 151 or 51. Thus, for instance, assuming the larger diameter conduit to have the switch-actuating flanged anchor connectors 161, 161, as in the illustrative embodiment, and the normal condition of OR gate to be direct to accumulator register 253, the adjuster 253 would be a multiplier with a multiplying factor b equal to the calculated, or preferably empirically tested and determined, ratio of pumped flow rate through the larger conduit 151 by peristaltic pump 20 relative to the flow rate through the other smaller conduit whose flanged anchor connectors 61, 61 are configured so as not to actuate switch 229 when such smaller conduit is connected and anchored in place on the pump 11. Vice versa, if the normal condition of OR gate 251 is through adjuster 253 and the larger sized conduit 151 has the actuating flanged anchor connectors 161, 161 thereon, the adjuster 253 in such a case could suitably be a divider, with an appropriate division factor b, or if a multiplier were employed, the factor b would be suitably less than unity (i.e., 1/b) to provide the desired differential in counts fed to the accumulator register 55 during respective pumping through the two differently sized conduits 51 or 151. The reverse of these arrangements could be applied if the smaller of the tube sets 61 had the switch-actuating flanged anchor connectors 161, 161 formed thereon.

Any of several different switching arrangements may be employed, as may be desired, to effect the desired differential count registry in accumulator register 255.

Also, while a simple flange-actuated switch arrangement 229, 229a is illustrated and preferred, various other types of sensors and switches could be employed, such as magnetic or optical switches with an appropriate actuator on the respective actuating conduit. Further more complex switching arrangements, as with additional series cascaded and/or parallel switches and/or signal control gates, might be employed to sense and accommodate more than two different sized conduits if so desired with appropriate selectively usable multiplier/divider adjusters for the various sized conduits.

The output of count accumulator register 255 is continuously inputted to a comparator 257 whose other input is from a desired end count register 261. When the count accumulator register 255 has accumulated a count equal to that in the desired end count register 261, the comparator 257 actuates and opens previously closed motor start/stop control switch 259 to thereby stop the feeding of pulses to the motor M, thus effectively stopping the motor and cutting off further pumping by the pump 11.

The desired end count register 261 is set to a desired value by inputting a desired volume and/or by subsequently inputting an actual measured volume $V_M$ resulting from operation of the pump 11 based on the initial setting of a desired volume $V_D$. As is subsequently described, the measured volume $V_M$ may be utilized in conjunction with the desired volume $V_D$ to adjust the desired end count register 261 to reflect any noted difference in actual flow rate through the given conduit 51 or 151 relative to the expected estimated or calculated flow rate.

Desired volume $V_D$ may be suitably inputted in digital form at desired volume input 271 as by a touch pad or keyboard which accommodates volume quantity inputs, e.g., liter, ml, etc, and this input 271 is fed to a multiplier 273 which converts the value $V_D$ to a suitable corresponding count by $(V_D)(n)$ by multiplication by a constant n which correlates with the pulse quantity/volume estimated or calculated to be pumped by the stepper motor-driven pump 11 for a pumping conduit of the base size which causes direct feeding of count accumulator register 255, as distinguished from the indirect feeding thereof through multiply/divide adjuster 253.

The resulant product output $(V_D)(n)$ is fed to a desired volume estimated count register 275 which has been suitably reset to zero prior to entry of the desired volume count $(V_D)(n)$ Initially, the output $(V_D)(n)$ of register 275 is passed through OR gate 277 to the desired end count register 261, the output of which register 261 in turn is inputted as one comparison input to comparator 257, against which comparison input the comparator compares as its other comparison input the running count accumulation output from count accumulator register 255.

Thus, when the set quantity in register 261 is equalled by the accumulated count in register 255 the comparator 257 will actuate the motor start/stop switch 259 to off or open condition, where it will remain until it is again manually or otherwise suitably automatically or otherwise reactuated to on or closed condition.

While one particular illustsrative and preferred mode of practice of an arrangement and method is illustrated and described according to this aspect of the invention which effects automatic adjustment of the number of pump pulses applied to pump a given desired quantity of fluid to compensate for differences in pumping conduit internal size is illustrated and described, it will be apparent that this aspect of the invention may be effected with various other arrangements and modes of practice. For instance, in lieu of adjusting the actual resulting running count corresponding to the pulse count to the motor M and which is employed as one comparison input, the representation of the desired volume input value $V_D$ or the product $(V_D)(n)$ may be alternatively appropriately selectively multiply/divide-adjusted or not and fed through a switch-controlled OR gate which may be controlled by switch 229. Suitable flow locations for insertion of such OR gate controlled adjust/nonadjust count control could be between multiplier 273 and register 275 or between input 271 and multiplier 273. Or the multiplier 273 or an additional multiplier could be controlled as a function of actuation of switch 229 to provide a different total multiple of the selected desired value $V_D$, as a function of whether switch 229 is actuated or not. The particular arrangement or mode of practice is widely variable and various modes of practice will be readily apparent to those skilled in the art when following the broad teachings herein of my invention, and as the particularities of the selected mode of practice do not form a part of the invention, such will not be further illustrated or described in detail.

There are many variables affecting the accuracy of a specific tube set and application. The pump may calculate the theoretical or estimated required number of rotary steps for a known tube diameter, pump speed, inlet and outlet pressure and other variables if known. However, as a practical matter for a pump such as this with a wide variety of applications, it is not possible to know all of the variables. In addition, there will be some tolerance in the tube dimensions or physical characteristics which will affect accuracy.

To provide the user with a simple and easy recalibration adjustment, this invention utilizes a means of inputting the actual delivered volume from a measured initial test volume delivered by the pump. The computer control will then calculate the ratio of the desired volume relative to the actual delivered volume and use this ratio to modify the number of pulsed rotary steps of the stepping motor to provide the desired correct volume. the computer may then selectively retain the adjustment or correction ratio in memory, if desired, so that this correction can be made for subsequent input desired volume pumping cycles when the same tube set and inlet/outlet conditions exist.

While the calculated or estimated value n of pulses/unit volume as employed may provide an acceptable degree of accuracy in some instances, as noted above, there may nevertheless be situations where greater accuracy is required in the actual volume of fluid delivered. To this end, as generally and briefly discussed above according to another aspect of the invention, provision is made for adjustment of the desired volume estimated count value $(V_D)(n)$ by a factor which effectively substantially compensates for the difference between the desired pumped volume and the actual measured pumped volume $V_M$ resulting from use of the calculated or estimated pulses/quantity pumped. According to a preferred mode of practice of this aspect of the invention, after conclusion of operation of the pump 11 with a given tube set fluid conduit 51 or 151 and fluid being pumped, the volume $V_M$ of fluid pumped from the conduit 51 or 151 is measured, either visually or otherwise as desired. It has been found that, for most normal conditions and requirements, personal visual measurement is adequate to provide an acceptable basis for adjustment of the pumped volume $V_M$ to a value well within acceptable tolerance limits relative to the desired volume $V_D$.

According to this aspect of the invention, the measured volume $V_M$, resulting from operation of the pump when a desired volume $V_D$ has been inputted, is inputted as through manual actuation of measured volume input unit 281, which may be a keyboard, touchpad or other suitable digital input device, the measured value $V_M$ being inputted being in the same selected unit of measure quantity as employed for inputting the desired input $V_D$. This value is multiplied in multiplier 283 by the factor n to provide a measured volume count $(V_M)(n)$ which is inputted to cleared measured volume count register 285, the output $(V_M)(n)$ of which is i putted as the divisor to divider 287. Also inputted to divider 287 as the dividend therefor is the count value $(V_D)(n)$ from the volume estimated count register 275. The quotient $V_D/V_M$ output from divider 287 reflects in usable nearest digital count value the ratio of the desired volume $V_D$ relative to the actual measured volume $V_M$ produced by employing the estimated or calculated multiple n to provide the pulse quantity $(V_D)(n)$ for operation of the pump 11 in an effort to pump the desired volume $V_D$.

Output $V_D/V_M$ from divider 287 is fed through selectively opened normally closed gate 288 into cleared register 289, after which gate 288 is closed until a new value $V_D/V_M$ is desired to be inputted to register 289, at which latter time register 289 may be cleared by its reset input, and gate control 288*a* may be actuated to open gate 288 and permit passage of the new value of $V_D/V_M$ into $V_D/V_M$ register 89. The output V from register 289 is continuously available and inputted as one multiplier input into multiplier 291, the other input to multiplier 291 being the desired volume estimated count $(V_D)(n)$ from register 275. The product $(V_D^2)(n)/(V_M)$ is a count value (which may be suitably rounded off to the nearest whole digital value) which reflects the original estimated count $V_D(n)$ adjusted by the ratio or percentage adjustment factor $V_D/V_M$ to thereby make a correction for the measured variation in pumped quantity resulting from use of this count value $(V_D)(n)$ as the pulse generating input for pump 11.

Register 261 is suitably reset/cleared, and the OR gate 277 is thereupon actuated by a suitable gate control 279 to switch the input to the cleared desired end count register 261 so that the output $(V_D^2)(n)/(V_M)$ is inputted through OR gate 277 to the desired end count register 261. Thereupon, the pump 11 is restarted by actuation of start/stop switch 259, and when the count accumulator register 255 registers the same number of counts as the count value $(V_D^2)(n)/V_M$ outputted from the desired end count register 261, the comparator 257 effects an output signal which actuates the on/off switch to its normal off condition, thereby stopping the pulse drive actuation of motor M and pump 11 driven thereby. The pumped quantity of the given fluid through the given tube set conduit 51 or 151 will thus be an amount which is adjusted for the measured difference between the desired volume $V_D$ and the measured volume $V_M$, the adjustment being an increase or decrease reflected by the adjustment factor ratio of the desired volume $V_D$ relative to the measured volume $V_M$.

The $V_D/V_M$ register 289 may retain its registered value until such register is reset and gate 288 is subsequently opened to enable registry of a new value $V_D/V_M$ therein, as may result from pumping action with different conditions, such as using different pumping conduit 51 or 151, and/or pumping a different fluid. Thus, by retaining the value $V_D/V_M$ in memory register 289, additional further desired volume quantities $V_D$, which may be the same as previously inputted at desired volume input 271, may again be outputted as desired by pump 11 by merely start reactuating start/stop switch 259, as the desired end count register 261 will retain the adjusted desired end count for the previous desired volume input $V_D$ until reset. Alternatively, the previously determined ratio value $V_D/V_M$ may be retained in register 89 and reused as a further adjustment factor input to multiplier 91, for a desired new input value of $V_D$ inputted through input 271 and multiplier 273 to cleared desired volume estimated count register 275; and by operating OR gate 277 to pass the resulting output $(V_D^2)(n)/(V_M)$ to desired end count register 261, the same previously resulting correction or adjustment factor $V_D/V_M$ applicable for operation of the pump 11 to pump an identically proportionately adjusted more accurate quantity of fluid, will be reflected in the pump operation, without necessity for again measuring the quantity pumped and inputting such through input 281, with essentially the same degree of corrected accuracy, assuming the same conditions are maintained for the pump, including same pump speed, same conduit, and same fluid, etc., the only operating difference being the desired volume quantity $V_D$. When any condition other than desired volume to be pumped is changed, it is desirable that the $V_D/V_M$ register be cleared, and the previously described test pumping, measuring and, if necessary, adjusting of fluid quantity pumped, by forming and registry in register 289 of a new adjustment factor $V_D/V_M$ by appropriately opening and then closing of gate 288, as by gate control 288*a*.

If desired where the accuracy enhancing feature involving inputting of the measured actual pumped volume is not required, the portions of the circuit of FIG. 6 for carrying out this feature may be omitted. An electromechanical block diagram illustrating this modification is shown in FIG. 7, in which the tube set 161 is shown for illustrative purposes. The various operating elements of the system as illustrated are similarly numbered and operate essentially the same as the corresponding operating elements of the embodiment and mode of practice of FIG. 6, as previously described above and such circuit will not be further described.

While the foregoing system and method has been illustrated and described generally in hardware form and terms, it will be appreciated that such may, and may in a given instance preferably, be effected in large measure by suitable corresponding software and/or firmware programming and operation of a computer or computers by such programming in conjunction with such hardware of the system as may be deemed desirable.

While the invention has been illustrated and described with respect to several illustrative embodiments and modes of practice, it will be apparent to those skilled in the art that various modifications and improvements may be made without departing from the scope and spirit of the invention. For example, other forms of pumps may be used in lieu of stepping motor-driven pumps, such as peristaltic pumps driven by a DC motor in conjunction with a digital output signal which is a function of the fluids pumping movement of the pump, which digital signal may then serve as the input to a digital count accumulator register such a count accumulator register 255 for comparison by comparator 257 with a digital value, either estimated or adjustment corrected, corresponding to the amount of pump movement required for pumping a desired quantity of fluid. Accordingly, the invention is not to be limited by the illustrative embodiments and modes of practice, but only by the scope of the appended claims.

I claim:

1. For use with a rotary peristatltic pump having a rotor and a stator, said stator having a conduit-engageable guide surface facing said rotor and defining a peristaltic pumping path for a fluid conduit, means for rotating said rotor in peristaltic pumping relation relative to said stator, and two conduit-anchoring elements for effectively anchoring a conduit in peristaltic pump-enabling relation between said stator and said rotor and along said peristaltic pumping path, each of said conduit-anchoring elements having a conduit-receiving opening and extending on transversely opposite lateral sides of said conduit-receiving opening, the arrangement comprising a fluid conduit having a rotor/stator-engageable peristaltic pumping section engageable in peristaltic pumping relation between said stator and said rotor, said fluid conduit having two transverse anchor flange means spaced apart thereon, with said peristaltic pumping section disposed longitudinally therebetween, for anchored retention of said conduit peristaltic pumping section in operative mounted relation along said peristaltic pumping path, said transverse anchor flange means being selectively laterally slidably removably engageable in effectively anchoring relation with said conduit-anchoring elements and with said peristaltic pumping section extending along said peristaltic pumping path, to thereby effectively anchor said pumping section of said conduit relative to said stator, and in peristaltic pump action enabling relation between said stator and said rotor when said transverse anchor flange means are in effective engagement within said conduit anchoring elements, each of said transverse anchor flange means having an outer transverse width substantially transversely complementary to the corresponding width of the said anchor slot in a respective said conduit-anchoring element, both of said transverse anchor flange means having substantially the same effective corresponding transverse width along a slot-engaging portion thereof slidably engageable in anchoring relation with the anchor slot of a respective said conduit-anchoring element, said substantially same width portion being freely and substantially similarly locationally laterally slidably complementarily and interchangeably engageable within either of said anchor slots, both of said spaced apart transverse anchor flange means having a substantially rectangular configuration in a plane transverse to the adjoining respective portion of said conduit.

2. The arrangement according to claim 1, both of said spaced apart transverse anchor flange means having a substantially square configuration in a plane transverse to the adjoining respective portion of said conduit.

3. The arrangement according to claim 1, said rectangular configuration having two parallel sides longer than the other parallel sides at right angles thereto.

4. For use with a rotary pump having a rotor and a stator, said stator having a conduit-engageable guide surface facing said rotor and defining a peristaltic pumping path for a fluid conduit, means for rotating said rotor in peristaltic pumping relation relative to said stator, and two conduit-anchoring elements for effectively anchoring a conduit in peristaltic pumping-enabling relation between said stator and said rotor and along said peristaltic pumping path, in which said pump has a control switch for controlling the actuation of said pump, the arrangement comprising a fluid conduit having a rotor/stator-engageable peristaltic pumping section engageable in peristaltic pumping relation between said stator and said rotor, said fluid conduit having two anchor means spaced apart thereon, with said peristaltic pumping section disposed longitudinally therebetween, for anchored retention of said conduit peristaltic pumping section in operative mounted relation along said peristaltic path, said anchor means being selectively removably engageable in effectively anchoring relation with said conduit-anchoring elements and with said peristaltic pumping section extending along said peristaltic pumping path, to thereby effectively anchor said pumping section of said conduit relative to said stator, and in peristaltic pump action enabling relation between said stator and said rotor when said anchor means are in effective engagement with said conduit anchoring elements, and switch actuator means on said fluid conduit operable to actuate said control switch as a function of said fluid conduit being in effectively anchored seated engagement along said peristaltic pumping path.

5. The arrangement according to claim 4 for use with a rotary peristaltic pump in which said control switch has a switch-actuating sensing element adjacent one of said conduit-anchoring elements, said switch actuator means comprising a transversely extending protuberance on said conduit slidably insertable in seated relation within said one of said conduit-anchoring elements and forming a portion of one of said anchor means and which transversely extending protuberance is locatable in effective switch-actuating relation with said switch-actuating sensing element as a function of seated anchoring engagement of said one of said anchor means with said one of said conduit-anchoring elements.

6. The arrangement according to claim 5, said transverse protuberance being physically engageable in switch-actuating relation with said switch-actuating sensing element as a function of seated engagement of said anchor means with said one conduit-anchoring element.

7. The arrangement according to claim 5, said fluid conduit having a second transversely extending protuberance on said conduit and forming a portion of the other said anchor means, which said second protuberance is locatable in switch-actuating relation with said switch-actuating sensing element as a function of seated anchoring engagement of said other anchor flange means within the same said one of said conduit-anchoring elements.

8. The arrangement according to claim 7, wherein said second tranversely extending protuberance is physically engageable with said switch-actuating sensing element as a function of seated engagement of its respective said other anchor means within said one conduit-anchoring element.

9. The arrangement according to claim 4 for use with a rotary peristaltic pump in which said control switch has a switch-actuating sensing element adjacent one of said conduit-anchoring elements, each of said flange means including a conduit anchor, said switch actuator means comprising a transverse transversely extending protuberance on said conduit slidably insertable in seated relation within said one of said conduit-anchoring elements and forming a portion of one of said anchor flange means and which transversely extending protuberance is locatable in effective switch-actuating relation with said switch-actuating sensing element as a function of seated anchoring engagement of said one of said anchor flange means within said one of said conduit-anchoring elements.

10. The arrangement according to claim 9, said transverse protuberance being physically engageable in switch-actuating relation with said switch-actuating sensing element as a function of seated engagement of said transverse flange means within said one conduit-anchoring element.

11. The arrangement according to claim 9, said fluid conduit having a second transversely extending protuberance on said conduit and forming a portion of the other said anchor flange means, which said second protuberance is locatable in switch-actuating relation with said switch-actuating sensing element as a function of seated anchoring engagement of said other anchor flange means within the same said one of said conduit-anchoring elements.

12. The arrangement according to claim 4, in which said pump having a control switch for controlling the operation of said pump, which switch has a switch-actuating sensing element adjacent one of said conduit-anchoring elements, each of said anchor means including a conduit anchor flange, said fluid conduit further comprising switch-actuator means on said fluid conduit and adjacent one of said conduit anchor flanges, said switch actuator means actuating said switch by actuating said switch-actuating sensing element as a function of seated engagement of said one of said flanges with said one of said conduit-anchoring means.

13. The arrangement according to claim 12, wherein said fluid conduit has alternative switch-actuator means thereon adjacent the other of said conduit anchor flanges, and which said alternative switch actuator means is operable to actuate said switch-actuating sensing element as a function of seated engagement of said other of said flanges with said one of said conduit-anchoring elements.

14. The arrangement according to claim 13, wherein each of said two switch actuator means comprises a further transverse flange on said fluid conduit, each of said further flanges being disposed longitudinally substantially identically relative to said pumping section of said fluid conduit, said longitudinal disposition of said switch-actuator further transverse flange being in effective switch actuating registry with said switch-actuating-sensing means when the respective adjacent said anchor flange is in effectively seated relation within said anchor slot of said one conduit anchoring element whereby said switch will be actuated as a function of anchored seating of both of said anchor flanges and said conduit within said conduit-anchoring elements and with said conduit having either of its respective opposite ends disposed on one of the fluid intake or fluid outflow side of said pump, and with the other opposite end being disposed on the respective other of the intake or outflow sides of said pump.

15. The arrangement according to claim 14, in which each of said further transverse flanges is rectangular in shape in a plane transverse to the adjoining portion of said conduit.

16. The arrangement according to claim 15, said rectangular shape having one of its rectangular dimensions greater than its other dimension, said other dimension transversely defining parallel flange surfaces forming said switch actuator means.

17. The arrangement according to claim 12, in which each of said further flanges is spaced from its said adjacent anchor flange and which serves the dual functions of switch actuation and guiding and anchoring of said conduit within said anchor slot of a respective said conduit-anchoring element.

18. For use with a rotary pump having a rotor and a stator, said stator having a conduit-engageable guide surface facing said rotor and defining a peristaltic pumping path for a fluid conduit, means for rotating said rotor in peristaltic pumping relation relative to said stator, and two conduit-anchoring elements for effectively anchoring a conduit in peristaltic pumping-enabling relation between said stator and said stator and along said peristaltic pumping path, said pump having a control switch for adjusting the pumping actuation of said pump, and switch-actuating sensing means adjacent one of said conduit-anchoring elements, the arrangement comprising a fluid conduit having a rotor/stator-engageable peristaltic pumping section engageable in peristaltic pumping relation between said stator and said rotor, said fluid conduit having two anchor means spaced apart thereon, with said peristaltic pumping section disposed longitudinally therebetwee, for anchored retention of said conduit peristaltic pumping section in ioeratuve mounted relation along said peristaltic path, said anchor means being selectively removably engageable in effectively anchoring relation with said conduit-anchoring elements and with said peristaltic pumping section extending along said peristaltic pumping path, to thereby effectively anchor said pumping section of said conduit relative to said stator, and in peristaltic pump action enabling relation between said stator and said rotor when said anchor means are in effective engagement with said conduit anchoring elements, said peristaltic pumping section of of said conduit having pumped fluid flow characteristics such that said pump may substantially properly effect pumping action in conjunction therewith without necessity for operation of said switch and such that actuation of said switch and adjustment of said total pumping action is inappropriate for pumping action by said pump through said conduit, said conduit being devoid of means for effectively actuating said switch-actuating sensing means as a function of seated acchoring engagement of each of said anchor flange means with a respective one of said conduit anchoring elements.

19. The arrangement according to claim 18, for use with a rotary peristaltic pump wherein said switch-actuating sensing element comprises a physically movably actuatable-sensing element extending within said transverse slot of said one of said conduit-anchoring elements, said arrangement further comprising both of said spaced apart transverse anchor flange means being jointly and interchangeably seatable in operable conduit-anchoring relation within said transverse slots of said conduit-anchoring elements and with said peristaltic pumping section disposed along said peristaltic pumping path, only and solely without any actuation of said switch-actuating sensing element.

20. For use with a rotary peristaltic pump having a conduit-engageable guide surface facing said rotor and defining a peristaltic pumping path for a fluid conduit, means for rotating said rotor in peristaltic pumping relation to said stator, two conduit-anchoring elements for effectively anchoring a conduit in peristaltic pumping-enabling relation between said stator and said rotor and along said peristaltic pumping path, each of said conduit-anchoring elements having a conduit-receiving opening and an anchor slot transverse to said conduit-receiving and extending on transversely opposite lateral sides of said conduit-receiving opening, said pump having a control switch for adjusting the total pumping action of said pump, and switch-actuating sensing means adjacent one of said conduit-anchoring elements, each of said transverse anchor slots having a transverse extent bounded by spaced opposing side walls and having a longitudinal extent bounded by longitudinally spaced opposing end walls having said conduit-receiving opening therein, and said physically movable actuatable sensing element extending within said one transverse slot of said one of said conduit-anchoring elements at a location substantially closer to one of said walls than to the opposing other of said end walls, the arrangement comprising a fluid conduit having a rotor/stator-engageable peristaltic pumping section engageable in peristaltic pumping relation between said stator and said rotor, said fluit conduit having two transverse anchor flange means spaced apart thereon, with said-peristaltic pumping section disposed longitudinally therebetween, for anchored retention of said conduit peristaltic pumping section in operative mounted relation along said peristaltic pumping path, said transverse anchor flange means being selectively laterally slidably removably engageable in effectively anchoring relation with said conduit-anchoring elements and with said peristaltic pumping section extending along said peristaltic pumping path, to thereby effectively anchor said pumping section of said conduit relative to said stator, and said rotor when said transverse anchor flange means are in effective engagement within said conduit anchoring elements, one of said anchor flange means having a first transversely extending anchor flange with a transversely extending dimension generally freely slidably guidably complementary to the transverse dimension formed by said lateral walls of said slot in said one conduit-anchoring element, said one ancho flange means further comprising a further transversely extending anchor flange longitudinally adjacent said first transversely extending anchor flange and having a transverse dimension substantially lell than the corresponding transverse dimension of said slot in said one conduit-anchoring element and being effectively disposed in non-actuating relation relative to said physically movably actuatable sensing element when said one transversely extending anchor flange means is effectively operationally seated within said anchor slot of said one conduit-anchoring element, the longitudinal dimension between the longitudinally oppositely outer facing surfaces of said one transversely extending anchor flange and said further transversely extending anchor flange being substantially freely slidably generally complementary to the longitudinal dimension between the corresponding portions of the opposing end walls of said slot in said one conduit-anchoring element, whereby said one flange means is substantially freely slidably insertable and seatable in said slot of said one conduit-anchoring element and whereby in its seated position said one transverse flange and said further transverse flange effectively longitudinally anchor said conduit in position in said one conduit-anchoring element.

21. The arrangement according to claim 20, said first flange having transversely spaced parallel oppositely facing outer end surfaces on opposite sides of said conduit and which are freely slidable in laterally guided substantially complementary relation with and between said slide walls, said first flange having one longitudinal guiding and anchoring face freely slidable in longitudinally guided relation with one of said end walls, said further flange being disposed in spaced relation from and on the opposite longitudinal side from said one longitudinal face and having a further longitudinal guiding and anchoring face facing longitudinally oppositely away from said one longitudinal face, which said one face and said further face are spaced apart by a dimension which is substantially complementary to the corresponding longitudinal spacing dimension of said end walls when said conduit and said first flange and said further flange are seated within said transverse slot in said one conduit-anchoring element.

22. A tube set for connection to a peristaltic pump having a pump operation adjustment-controlling switch, said tube comprising:

a fluid conduit which includes a peristaltic pumping tube engageable in peristaltic pumping enabling relation with said peristaltic pump, and interconnected with an inlet tube and an outlet tube, two transversely extending ancho- flange means on said conduit and enabling operation-enabling anchored connection of said tube set to said pump, said peristaltic pumping tube having a peristaltic pumping section disposed between said anchor flange means, and each of said anchor flange means having switch-actuating means enabling actuation of said switch in response to operable anchored connection of said anchor flanges and said fluid conduit to said pump.

23. A tube set according to claim 22, said two anchor flange means being disposed in operational fluid flow connecting relation respectively between said inlet tube and said peristaltic pumping tube and between said outlet tube and said peristaltic pumping tube.

24. A tube set according to claim 22 for connection to a peristaltic pump having spaced tube set anchoring connection means and a pump operation adjustment-controlling switch adjacent one of said anchoring connection means, each of said anchor flange means being transversely slidably engageable in anchoring relation with said spaced tube set anchoring connection means, each of said switch-actuating means being disposable in switch-actuating relation with said switch as a function of anchored connection of its respective said anchor flange means with said one of said anchoring connection means.

25. A tube set according to claim 24 for connection to a said peristaltic pump in which each of said anchoring connection means includes spaced longitudinal parallel walls forming a transverse slot open at one lateral side, and said switch is disposed with a switch-actuation sensor element adjacent said slot of one of said anchoring connection means, said tube set further comprising:

each of said anchor flange means being alternatively engageable within either of said anchoring connection means.

26. A tube set for connection to a peristaltic pump having two tube set anchoring means and connection means, each of which includes spaced longitudinally parallel side walls and transversely parallel end walls forming an anchoring connection slot, a pump operation adjustment-controlling switch which has a switch actuation sensor operationally adjacent one of said anchoring connection means, said tube set comprising:

a fluid conduit which includes an inset tube, an outlet tube and a peristaltic pumping tube, and tube-connecting means connecting said peristaltic pumping tube in fluid flow connecting relation between said inlet tube and said outlet tube, two transversely extending anchor flange means formed on said conduit in spaced apart relation for anchoring said tube set to said pump, each of said anchor flange means being interchangeably and alternatively laterally slidably operationally engageable in, and removable from, tube set-anchoring anchoring relation with either of said anchoring connection slots and in paired respective relation concurrently respectively with both of said anchoring connection slots to thereby removably connect said tube set in anchored operation-enabling relation on said pump.

27. A tube set according to claim 26, said anchor flange means comprising said tube-connecting means.

28. A tube set according to claim 27, each said anchor flange means including switch-actuating means for actuating said switch as a function of lateral slidable seated engagement of either of said anchor flange means within said slot of said one anchoring connection means.

29. A tube set according to claim 28, said switch-actuating means of each of said anchor flange means being formed by a transverse wall of the respective said anchor flange means.

30. A tube set according to claim 27, each of said anchor flange means being devoid of switch-actuation means effective to actuate said switch as a function of effective anchored seating of either of said anchor flanges within said one anchoring connection means having said switch-actuation sensor adjacent thereto and as a function of fully pump operation-enabling seated engagement of both of said anchor flange means with respective ones of said anchoring connection means.

31. For use with a pulse-actuated stepping motor-driven peristaltic pump having connecting means for connecting a selectable one of two differently-cross-sectional-sized fluid conduits to said pump for pumping fluid therethrough, pumped volume registry means which indicates pumped fluid volume as a function of the number of pulses applied to said stepper motor and a first multiplier value considered appropriate for one of said two conduits and adjustment means for effectively adjusting said multiplier to a second value considered appropriate for the other of said two conduits, and connecting means associated with said pump for operably connecting a fluid conduit to said pump, the combination of first and second radially compressible fluid conduits having substantially equal compressible wall thicknesses and respectively different inner fluid passageway cross-sectional areas in a zone engageable in compressible peristaltic pumping relation with said pump, which fluid passageway cross-sectional area and fluid flow characteristics for said first conduit are consonant with said first given multiplier value, said first and second fluid conduits being interchangeably operably connectable in pumping-enabling relation with and by said pump, said second conduit having a fluid passageway cross-sectional-area and flow rate characteristics with which said first multiplier value is not consonant but with which said second multiplier value is consonant, said second conduit having adjustment actuating means thereon operable as a function of connection of said one conduit in operable pumping-enabling relation to said pump, to actuate said adjustment means and thereby adjust said multiplier to said second value as a function of connection of said one conduit in operable relation to said pump, and said first conduit being operably connectible in pumping-enabling relation with said pump without actuation of said adjustment means.

32. The combination according to claim 31, wherein said adjustment means includes a switch, said adjustment actuating means on said one conduit comprising a switch actuator for actuating said switch as a function of operable connection of said second conduit to said pump.

33. The combination according to claim 31, wherein said adjustment means includes an actuatable element, said adjustment actuating means on said one conduit comprising connector means engageable in actuating relation with said actuatable element of said adjustment means as a function of seated connection of said connector means on said first conduit with said pump-associated connecting means.

34. The combination according to said claim 33, said connector means comprising a connector flange on said one conduit, which connector flange is engageable in actuating relation with said actuatable element of said adjustment means as a function of anchoring connection of said flange with said pump-associated connecting means.

35. For use with a peristaltic pump having a rotor, a stator, a motor connected in driving relation to said motor, control switch means for controlling an aspect of flow quantity operation of said motor, and connecting/anchoring means on said pump for connecting a compressible conduit to said pump in operable relation between said rotor and said stator, the combination of a set of a plurality of radially compressible conduits, two of which conduits have equal wall thicknesses and different flow passageway cross-sectional areas relative to one another in a peristaltic pumping zone engageable in peristaltic pumping relation with said pump by mounting of such zone between said rotor and said stator, each of said conduits having two connectors at longitudinally spaced positions thereon, the respective said peristaltic pumping zone of each respective said conduit being disposed longitudinally between said connectors, each of said conduits being operably connectible with said pump through operable engagement of its respective two connectors with respective connecting/anchoring means on said pump, only one of said two conduits having switch-actuating means thereon operable to actuate said control switch means as a function of operable engagement of one of its respective said connectors with the respective connecting means on said pump.

36. The combination according to claim 35, said switch-actuating means on said one conduit comprising one of said connectors on said one conduit.

37. The combination according to claim 36, said connectors comprising transversely extending protuberances on said conduit, which said protrusions are laterally slidably laterally insertably engageable with corresponding slotted elements on said pump, and which slotted elements are in spaced positions at opposite ends of the peristaltic pumping zone formed between said stator and said rotor of said pump, which slotted elements form said connecting/ anchoring means on said pump.

38. The combination according to claim 35, said connectors comprising transversely extending flanges on said conduit, which said flanges are laterally slidably laterally insertably engageable with corresponding slotted elements on said pump, and which slotted elements are in spaced positions at opposite ends of the peristaltic pumping zone formed between said stator and said rotor of said pump, which slotted elements form said connecting/ anchoring means on said pump.

39. The combination according to claim 35, the other of said two conduits of said set being operably engageable with said pump by anchoring connecting engagement of said connectors with said connecting/securing means on said pump without actuation of said control switch means.

40. The combination according to claim 39, said switch-actuating means on said one conduit being on of said connectors on said one conduit.

41. The combination according to claim 40, said connectors being laterally extending lfanges on said conduit and being laterally slidably insertably engageable with corresponding slotted elements on said pump, which slotted elements are disposed adjacent opposite ends of the peristaltic pumping zone formed between said stator and said rotor of said pump, which slotted elements form said connecting/anchoring means on said pump.

42. The combination according to claim 35, said two conduits having substantially equal wall thicknesses in said compressible peristaltic pumping zone.

43. A pump arrangement comprising a peristaltic pump first and second fluid conduits each having a peristaltic pumping section with a longitudinal fluid flow passageway therein alternately operably connectable in peristaltic pumping enabling relation to said peristaltic pump, said fluid flow passageway of said first fluid conduit peristaltic pumping section having a different effective cross-sectional area from that of said second conduit peristaltic pumping section, and pump operation adjustment switch means on said pump responsive to operable connection of said second of said conduits to said pump to effect a change in pumping activity of said pump from a first extent of activity to a second extent of activity which is consonant with said second conduit peristaltic pumping section cross section size for the pumping of a desired quantity of fluid through said second conduit by pumping activity of said pump, said pump operation-adjusted switch means being operably nonresponsive to operable connection of said first conduit to said pump, whereby said pump is enabled to effect peristaltic pumping activity according to said first extent of activity, which said first extent of activity is consonant with pumping of a desired fluid quantity through said first conduit by pumping activity of said pump.

44. A pump according to claim 43, each of said conduits having anchoring means thereon for anchoring connection of said conduit to said pump in peristaltic pumping-enabling relation thereto, the said anchoring means on said first conduit being different from the said anchoring means on said second conduit, said switch being actuatably responsive to said anchoring connection of said anchoring means on said second conduit to said pump, and said switch being actually nonresponsive to said anchoring connection of said anchoring means on said first conduit to said pump.

45. A pump according to claim 44, said anchoring means on said first and second conduits being different as to a given feature at a particular dimensional location thereof, and said pump operation adjustment switch means being actuatably responsive to the said given feature of said second conduit when said second conduit is anchored in operational connected relation to said pump, and being actuatably nonresponsive to the operationally effective seating of said first conduit anchoring means and of the corresponding presence of the entirety of said first conduit anchoring means adjacent actuating means for said switch when said first conduit is anchored in operational connected relation to said pump.

46. The method of pumping fluid through either of first and second conduits having different fluid passageway sizes, comprising:

alternateively pumping fluid through a selected one or the other of said conduits to effect a given selected pumped output quantity, said pumping of fluid through said first conduit being effected to a first extent of pumping activity consonant with said fluid passageway size of said first conduit, and said pumping of fluid through said second conduit being effected to a different extent of pumping activity relative to said first extent which is different by an adjustment factor which compensates for the difference of effective flow through said fluid passageway of said second conduit as a result of the fluid passageway size difference of said second conduit relative to said first conduit, and effecting said adjustment as a function of effectively connecting said second conduit to said pump in fluid output pumping-enabling relation thereto.

47. The method according to claim 46 and further comprising:

enabling said adjustment as a function of connecting flanged anchoring means on said second conduit to corresponding anchoring connection means on said pump.

48. For use with a motor-driven peristaltic pump having connecting means for connecting a selectable one of two differently-cross-sectional-sized fluid conduits to said pump for pumping fluid therethrough, pumped volume registry means which indicates pumped fluid volume as a function of the amount of fluid pumping movement of said pump and a first multiplier value considered appropriate for one of said two conduits and adjustment means for effectively adjusting said multiplier to a second value considered appropriate for the other of said two conduits, and connecting means associated with said pump for operably connecting a fluid conduit to said pump, the combination of first and second radially compressible fluid conduits having substantially equal compressible wall thicknesses and respectively different inner fluid passageway cross-sectional areas in a zone engageable in compressible peristaltic pumping relation with said pump, which fluid passageway cross-sectional area and fluid flow characteristics for said first conduit are consonant with said first given multiplier value, said first and second fluid conduits being interchangeably operably connectable in pumping-enabling relation with and by said pump, said second conduit having a fluid passageway cross-sectional-area and flow rate characteristics with which said first multiplier value is not consonant but with which said second multiplier value is consonant, said second conduit having adjustment actuating means thereon operable as a function of connection of said one conduit in operable pumping-enabling relation to said pump, to actuate said adjustment means and thereby adjust said multiplier to said second value as a function of connection of said one conduit in operable relation to said pump, and said first conduit being operably connectible in pumping-enabling relation with said pump without actuation of said adjustment means.

49. The combination according to claim 48, said first and second fluid conduits having substantially equally effectively compressible wall thickness in said compressible peristaltic pumping zone thereof.

* * * * *